United States Patent [19]

Brisson et al.

[11] Patent Number: 4,638,279

[45] Date of Patent: Jan. 20, 1987

[54] NOISELESS ELECTROMAGNET AND A CONTACTOR USING SUCH AN ELECTROMAGNET

[75] Inventors: Alain Brisson; Jean R. Clément, both of Poitiers, France

[73] Assignee: La Telemecanique Electrique, France

[21] Appl. No.: 756,618

[22] Filed: Jul. 19, 1985

[51] Int. Cl.[4] ..... H01F 3/00; H01F 7/08

[52] U.S. Cl. ..... 335/257; 335/261; 335/277; 335/247; 335/193

[58] Field of Search ..... 335/257, 261, 277, 279, 335/247, 248, 46, 90, 104, 105, 157, 158, 193

[56] References Cited

U.S. PATENT DOCUMENTS 1,226,748 5/1917 Burnham ..... 335/247
4,491,816 1/1985 Blum ..... 335/245

FOREIGN PATENT DOCUMENTS 2260176 1/1974 France .
2406885 10/1977 France .
1246605 3/1970 United Kingdom ..... 335/257

*Primary Examiner*—E. A. Goldberg
*Assistant Examiner*—Lincoln D. Donovan
*Attorney, Agent, or Firm*—William A. Drucker

[57] ABSTRACT

The electromagnet comprises a fixed magnetic circuit, a mobile magnetic circuit forming, with the fixed magnetic circuit, at least one air gap and a coil. The distance over which the mobile magnetic circuit travels with respect to the fixed magnetic circuit is limited by at least one working position stop determining the working position, this stop being provided with at least one working position damper.

5 Claims, 13 Drawing Figures

NOISELESS ELECTROMAGNET AND A CONTACTOR USING SUCH AN ELECTROMAGNET

The present invention relates to an electromagnet whose applications require noiseless operation, this electromagnet being able to form part of the most diverse devices and, in particular, of a contactor or contact-maker.

Generally, it is known that the regulation of household heating apparatus at night as well as devices for controlling a high power electric current in operating rooms require the use of noiseless means. Now, it so happens that, for these types of use, the controlled power levels and the insulation requirements mean that static relays or contactors are not yet in a position to replace electromagnetic contactors.

It is well known that, for such applications, electromagnets fed with direct AC current cannot be used because of the closure shocks and vibrations in the closed condition which still remain too high.

So studies have been made on contactors with a DC supply (fed with a rectified and filtered AC current) whose drive torque is adapted as well as possible to the variations of the resisting torque during closing, which limits the increases in drive power and, therefore, closure shocks, French Pat. Nos. 2 260 176 and 2 406 885 give two examples of this adaptation to the variations of the resistance forces.

Although very efficient, these solutions are still insufficient because more especially of the manufacture tolerances concerning the resistance forces and especially because of fluctuations in the supply voltages. Thus, arrangements made for guaranteeing operation under unfavourable conditions, cause when favourable conditions are present, an increase in energy at the end of closure which makes the closure shock sufficiently great from the auditive point of view for it to be troublesome.

The aim of the invention is therefore to overcome these disadvantages by providing damping of this energy increase on closure as well as the increase in energy for the return.

It provides therefore an electromagnet with DC supply, of the type comprising a fixed magnetic circuit, a magnetic circuit movable in translation and forming with the fixed magnetic circuit air gaps of variable width.

This electromagnet is more particularly characterized in that it comprises at least two air gaps, and in that one of the faces of the magnetic circuits which define each of these two air gaps is provided with a damping element made from an amagnetic material serving as working stop, which limits the width of each of the air gaps of the electromagnet to a minimum value, in the working position.

According to an advantageous characteristic of the invention, said damping elements may be formed from a molded piece made from silicon-coated elastomer.

Figure 1:
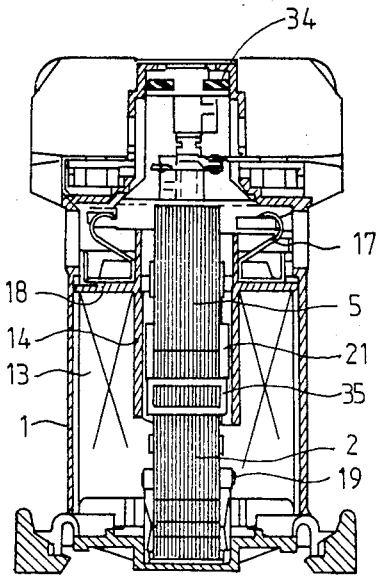
Figure 2:
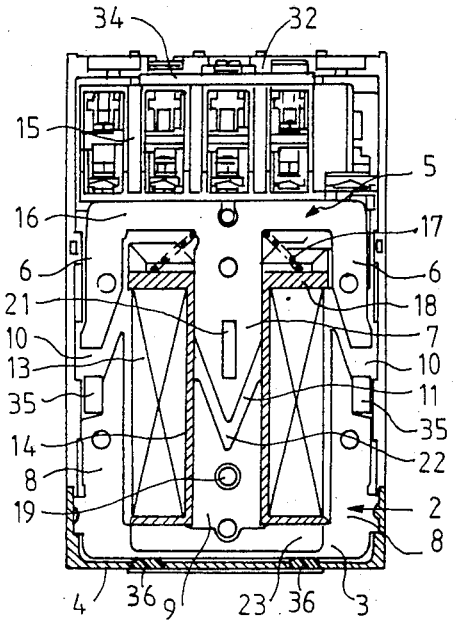
Figure 3:
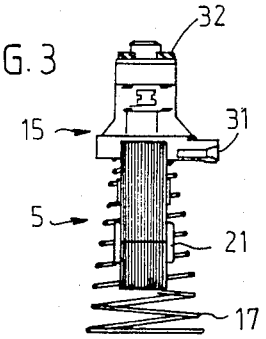
Figure 4:
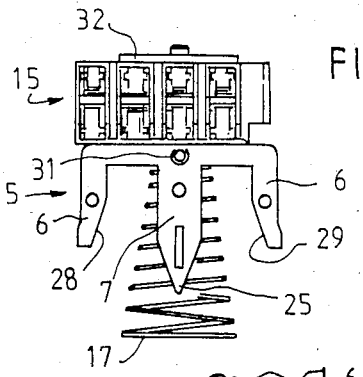
Figure 5:
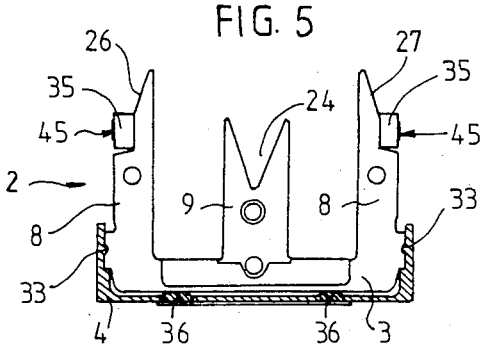
Figure 6:
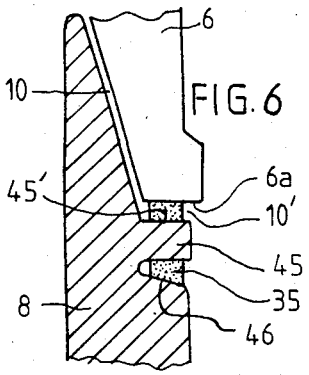
Figure 7:
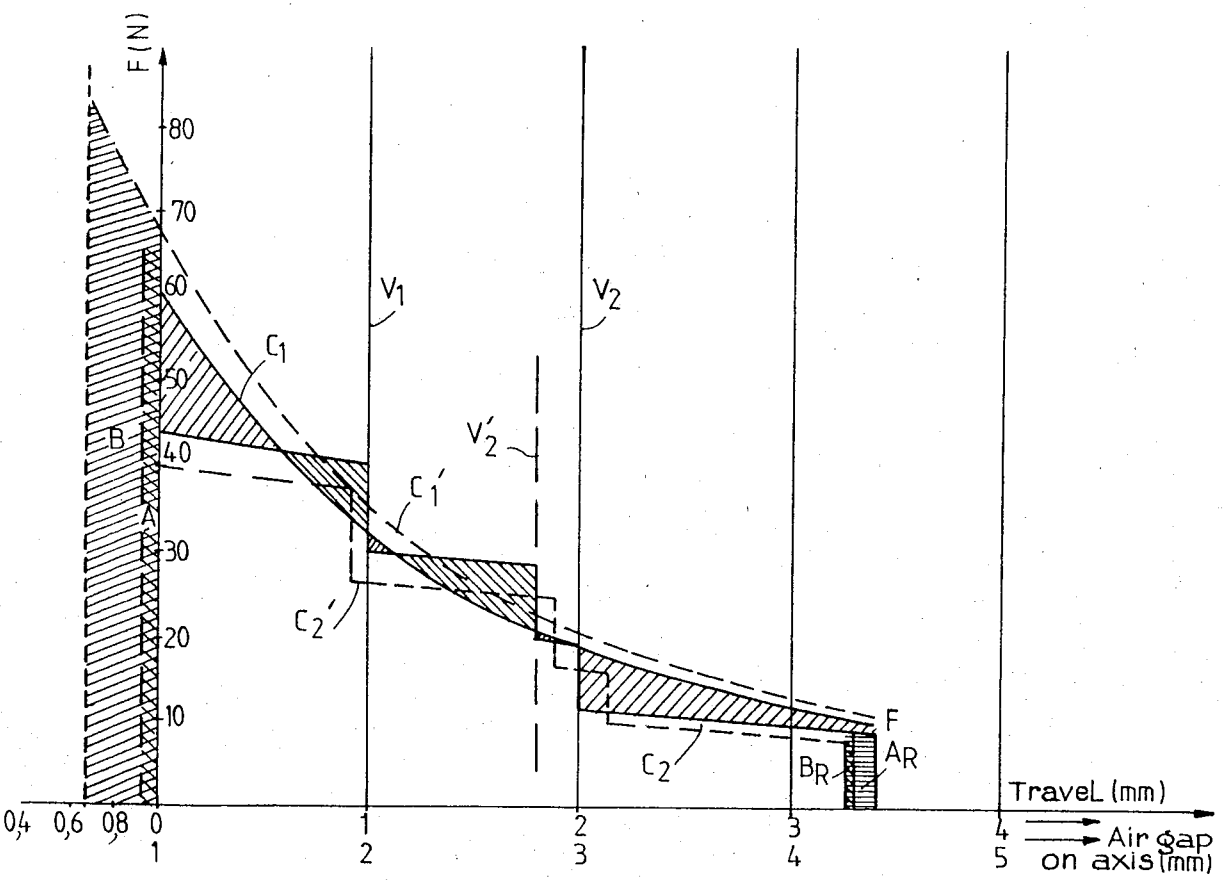
Figure 9:
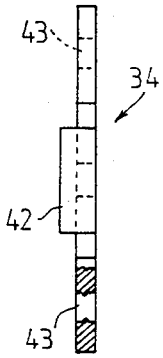
Figure 8:
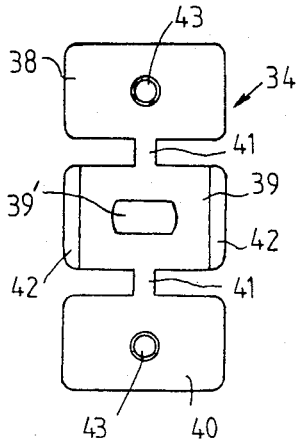

One embodiment of the invention will be described hereafter, by way of non limitative example, with reference to the accompanying drawings in which:

FIGS. 1 and 2 are two orthogonal sections of a contactor according to the invention, FIGS. 3 and 4 are two side views of the mobile assembly of the contactor shown in FIG. 1, FIG. 5 is a side view of the fixed part of the magnetic circuit, FIG. 6 is a detail showing the shape of the studs provided on the fixed magnetic circuit on which the working dampers are mounted, FIG. 7 is a diagram illustrating the laws of variation of the forces as a function of the travel distances of the mobile assembly of the contactor shown in FIG. 1, FIGS. 8 and 9 show, seen from the front (FIG. 9) and seen from the side (FIG. 8), the home position damper used in the contact of FIG. 1.

Figure 10:
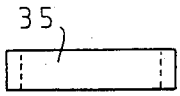
Figure 11:
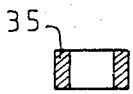
Figure 12:
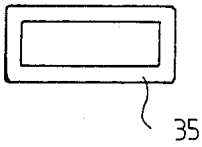
Figure 13:
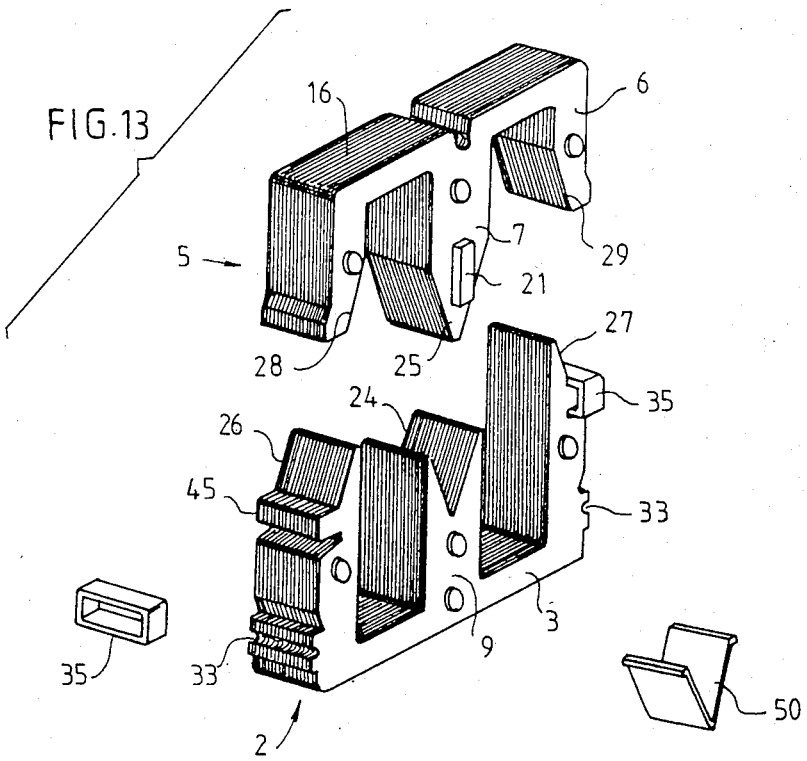

FIGS. 10, 11, 12 show, respectively, in a side view, in an axial section and in a top view, a working position damper, FIG. 13 is an exploded perspective view of the mobile and fixed magnetic circuits of the contactor shown in FIG. 1 with the working position dampers.

With reference to FIGS. 1 and 2, the contactor has a conventional structure of a translation contactor comprising, inside a case 1:

a fixed magnetic circuit 2, in the form of an E whose web 3 is fixed against a bottom plate 4 firmly secured to case 1, a mobile magnetic circuit 5, also in the shape of an E whose legs 6, 7 are aligned respectively with the legs 8, 9 of fixed magnetic circuit 2, the respective ends of legs 6, 7, 8, 9 of these two magnetic circuits being mutually facing each other and forming air gaps 10, 11, a coil 13 wound on a tubular carcase 14 and disposed in the volume between legs 6, 7, 8,9 of the fixed magnetic circuit 2 and of the mobile magnetic circuit 5, fixing means for fixing the carcase 14 of coil 13 to the fixed magnetic circuit 2, guide means for guiding the mobile magnetic circuit 5 in said carcase 14.

a mobile contact holding assembly 15 mounted on the web 16 of the mobile magnetic circuit 5, and at least one return spring 17 disposed between the upper shoulder 18 of carcase 14 of coil 13 and the web 16 of the magnetic circuit 5.

More precisely, in the example shown, the fixed magnetic circuit is secured in coil 13 by means of a cylindrical pin 19. Of course, the invention is not limited to such an arrangement. The fixed magnetic circuit 2, could, for example, be quite simply force fitted into the carcase 14 of coil 13.

For guiding it, the mobile magnetic circuit 5 comprises a key 21 cooperating with an axial groove 22 provided in the carcase 14 of coil 13.

The shapes of air gaps 10 and 11 are determined at the design stage for adapting the law of variation of the drive force to the resistant force.

Thus, in this example, the end of the central leg 9 of the fixed magnetic circuit has a V shaped recess 24, in which is engaged the end 25 of the central leg 7 of the mobile magnetic circuit 5 which accordingly has a substantially complementary convex V shape. These two complementary shapes 24, 25 define a substantially V shaped air gap 11.

Similarly, the ends of the two side legs 8 of the fixed magnetic circuit 2 each comprise an outer chamfered face 26, 27 and the ends of the two side legs 6 of the mobile magnetic circuit 5 each comprise an inner chamfered face 28, 29, the outer chamfered faces 26, 27 of the fixed magnetic circuit 2 cooperating with the inner chamfered faces 28, 29 of the mobile magnetic circuit 5 so as to form two lateral air gaps 10 oblique with respect to each other.

These shapes of the air gaps 10, 11 have the advantage of being readily reproducible for industrial mass production, because of the adoption of a technique for cutting out thin metal sheets assembled together by methods which are henceforth traditional (rivetting) for obtaining magnetic circuits with AC supply.

As mentioned above, FIGS. 3 and 4 show the mobile assembly of the contactor, in which the mobile magnetic circuit 6 is connected to the contact holding assembly 15 by a securing pin 31. The return spring 17 is in the totally relaxed state. In the working position, it serves for returning the mobile assembly back to the rest position, which position is shown in FIGS. 1. 2 in which the upper face of the mobile contact holding assembly 15 comes to bear, at the end of travel, on an abutment surface 32 provided on the upper wall of case 1, while balancing the contact forces (opening contact).

Such as shown in FIG. 5, the fixed magnetic circuit 2 comprises two lateral grooves 33 serving for mounting it by snap fitting into the bottom plate 4 of case 1. This bottom plate has a U shaped section surrounding the lower part of the fixed magnetic circuit 2 and whose legs comprise bosses for engagement in grooves 33.

The means for damping the opening and closing shocks comprise:

on the one hand, a rest position damper 34, made from a shock absorbing material for example from a silicon coated elastomer, fixed to the upper face of the mobile assembly 15 and which is consequently crushed against the abutment surface 32 provided on the upper face of case 1 when the mobile assembly returns to the rest position, and on the other hand, two working position dampers 35, also made from a resilient material, for example from silicon coated elastomer, fixed respectively to the two side legs 8 of the fixed magnetic circuit 2 and on which come to bear the ends of the side legs 6 of the mobile magnetic circuit 5 in the working position.

These means are completed by bearing elements such as bosses 36, made preferably from a thermoplastic material, provided between the web 3 of the magnetic circuit 2 and the web of the bottom plate 4, which serve for eliminating the play between these two parts and which contribute to damping the closure shocks of the contactor.

Such as shown in FIGS. 8 and 9, the rest position damper 34 is in the form of a plate made from a silicon coated elastomer formed in three parts 38, 39, 40, rectangular in shape and connected together by connecting lugs 41, namely a central part 39 and two lateral parts 38, 40. The central part 39 comprises a central recess 39' for fixing the damper 34 on the upper face of the mobile contact holding assembly 15 and two centering side flanges 42. The side parts 38 and 40 may also each comprise a central centering and/or fixing bore 43.

Of course, the invention is not limited to this particular form of the rest position damper 34; obviously, this particular form is only an adaptation of the invention to the forms of the mobile contact holding part 15 and all shapes of parts used for damping the return shock may be used within the scope of the invention.

FIGS. 10, 11 and 12 show the detail of the working position dampers 35. These working position dampers 35, two in number in this example, are each formed of a ring having a rectangular section and made from a silicon coated elastomer obtained by molding. They are fitted onto two respective studs 45 provided on the outer faces of the side legs 8 of the fixed magnetic circuit 2, substantially at the base of the chamfered faces 26, 27. These studs 45 form, with the ends of the side legs 6 of the mobile magnetic circuit, small lateral air gaps 10' distinct from the lateral air gaps which exist between the surface **6*a* and surface 45' (FIG. 6**).

These studs 45 are obtained by cutting out magnetic metal sheets at an appropriate angle 46 for facilitating the assembly of the rings forming dampers 35.

The position and the thickness of these dampers 35 against which the end of legs 6 of the mobile magnetic circuit 5 come into abutment, in addition to the role of damper, also fulfil the anti-remanence function of the air gaps 10, 11, the size of these air gaps being determined by the thickness which the compressed elastomer assumes when the armature is applied thereagainst. The choice of a silicon coated elastomer results from the requirements of resistance of the anti-remanent damper to the working temperatures of the electromagnet, to the oils used for cutting the metal sheets and high mechanical endurance. Moreover, the non adhesion qualities (gumming) of such an elastomer are advantageous for guaranteeing in time separation of the mobile circuit should a cut off occur in the power supply of the electromagnet. It is clear that any magnetic material having mechanical damping properties and appropriate for the requirements of endurance and resistance to the environmental conditions may be used within the scope of the invention.

FIG. 7 gives the operating laws for a contactor equipped with a damper in accordance with the invention. In this Figure which is a force F(N) diagram as a function of the travel of the mobile assembly and of the air gap curve $C_1$ shows the drive force for the minimum condition guaranteeing closure, curve $C_2$ represents the maximum resistance force related to the drive force shown in curve $C_1$, curve $C'_1$ shows the drive force under favourable closure conditions, curve $C'_2$ shows the resistant force related to the drive force represented by curve $C'_1$, the vertical of abscissa O corresponds to the end of travel without crushing of the dampers, the vertical $V_1$ of abscissa 1 corresponds to closure of the main and additional contacts, the vertical $V_2$ of abscissa 2 corresponds to the opening of the basic contacts, the additional contacts opening for a travel distance of abscissa $V'_2$ slightly less than 2.

Under unfavourable closure conditions (maximum resultant forces, minimum supply voltage) the difference between the positive energies (movement with drive force greater than the resistant force) and negative energies (resistant forces greater than the drive force overcome by the kinetic energy accumulated by the mobile assembly) is necessarily positive, otherwise closure of the contactor could not be guaranteed.

This difference of the areas between curves 1 and 2, hatched in opposite directions depending on whether they are positive or negative, is equal to area A at the left of O of the travel distance. Thus, dampers 10, 11 are crushed (0.08 mm in this application) while counterbalancing the energy increase, which thus allows a resultant zero shock to be obtained. When extreme favourable conditions are present (curves $C'_1$ and $C'_2$), crushing of the working position dampers 10, 11 corresponds to the absorption of the energy shown in zone B at the left of O of the travel distance. It is obvious that it is necessary to take measures so that the variations in crushing dampers 10, 11 do not compromise the qualities of the contacts F (closure contacts), nor influence too much the separation values of the contactor.

In this application, these conditions are fulfilled satisfactorily, since the overtravel of the contacts (about 1 mm) and of the longitudinal air gaps, without crushing the dampers 10, 11 (1 mm) remains large with respect to the crushing of the dampers 10, 11 (0.08 mm to 0.35 mm). Thus, it is evident that the shapes shown for dampers 10, 11 are only a particular application of the invention and that any specific adaptation remains within the scope of this latter.

Thus, the contactor might for example comprise, as shown in FIG. 13 a central damper 50, formed from a molded V shaped part, made from a sheet of amagnetic resilient material and being engaged in the V shaped concave recess 24 of the central leg 9 of the fixed magnetic circuit 2 (or possibly, on the convex portion 25 of the central leg 7 of the mobile magnetic circuit 5). This solution may be used more especially in the case when it is not desirable to have the mechanical bearing surface of the mobile and fixed magnetic circuits 5, 2 on the lateral legs 6, 8 of these circuits.

However, it should be noted that more generally three cases arise for location of the working position dampers:

(a) solely in the air gap 11, (b) solely in air gap 10 and/or in the side air gaps, (c) both in air gap 11 and in air gap 10 and/or air gap 10'.

Furthermore, in all the cases envisaged, it is always possible to provide, between all the slanted parts of armatures 27, 29; 26, 28, 24, 25, gaps filled with air or brass for overcoming the remanence effects.

We claim:

1. An electromagnet with DC supply which comprises a fixed magnetic circuit having an E shape including a first web, a first central leg having a first end face and two first side legs which comprise two respective outer faces each having a chamfered portion and a stud bearing a damper element made from an amagnetic material, which serves as working position stop of the electromagnet, and a mobile magnetic circuit movable in translation, said mobile magnetic circuit having an E shape including a second web, a second central leg having a second end face and two second side legs which comprise two respective inner faces each having a chamfered portion and an end surface which comes to bear on said damper element in the working position, said second central leg being aligned and disposed with said second end face facing said first end face so as to form a central air gap, and said two second side legs being respectively aligned with said two first side legs with said chamfered portions and said end surfaces of the second side legs facing respectively the chamfered portions and the studs of the two first side legs to form between said chamfered portions two lateral air gaps oblique with respect to each other and between said end surfaces and said studs two small end air gaps.

2. Electromagnet according to claim 6, wherein said damper elements consist of silicon coated elastomer rings mounted on said studs.

3. An electromagnet with DC supply which comprises a fixed magnetic circuit having an E shape including a first web, a first central leg having a first end face and two first side legs which comprise two respective outer faces having a chamfered portion, a mobile magnetic circuit movable in translation, said mobile magnetic circuit having an E shape including a second web, a second central leg having a second face and two second side legs which comprise two respective inner faces each having a chamfered portion, said second central leg being aligned and disposed with said second end face facing said first end face so as to form a central air gap, and said two second side legs being respectively aligned with said two first side legs with said chamfered portions of the two second side legs facing respectively the chamfered portions of the two first side legs to form therebetween two lateral slanted air gaps oblique with respect to each other and two lateral damper elements extending respectively in said slanted air gaps.

4. An electromagnet with DC supply which comprises a fixed magnetic circuit having an E shape including a first web, a first central leg having a first V-shaped concave end face, and two first side legs which comprise two respective outer faces each having a chamfered portion, a mobile magnetic circuit movable in translation, said mobile magnetic circuit having an E shape including a second web, a second central leg having a second V-shaped convex end face, and two second side legs which comprise two respective inner faces each having a chamfered portion, said second central leg being aligned and disposed with said second end face facing said first end face so as to form a central V-shaped air gap, and said two second side legs being respectively aligned with said two first side legs with said chamfered portions of the two second side legs facing respectively the chamfered portions of the two first side legs to form therebetween two lateral slanted air gaps oblique with respect to each other and a central damper formed from a V-shaped part molded from an amagnetic material which extends in said central V-shaped air gap.

5. An electromagnet with DC supply which comprises a fixed magnetic circuit having an E shape including a first web, a first central leg having a first V-shaped concave end face, and two first side legs which comprise two respective outer faces each having a chamfered portion, a mobile magnetic circuit movable in translation, said mobile magnetic circuit having an E shaped including a second web, a second central leg having a second V-shaped convex end face, and two second side legs which comprise two respective inner faces each having a chamfered portion, said second central leg being aligned and disposed with said second end face facing said first end face so as to form a central V-shaped air-gap, and said two second side legs being respectively aligned with said two first side legs with said chamfered portions of the two second side legs facing respectively the chamfered portions of the two first side legs to form therebetween two lateral slanted air gaps oblique with respect to each other, said electromagnet further comprising two lateral dampers extending respectively in said slanted air gaps and a central damper formed from a V-shaped part molded from an amagnetic material which extends in said central V-shaped air gap.

* * * * *